US009180712B1

(12) United States Patent
Stanich et al.

(10) Patent No.: US 9,180,712 B1
(45) Date of Patent: Nov. 10, 2015

(54) TEST PATTERNS FOR PRINT HEADS HAVING TWO IMAGE SOURCES

(71) Applicants: Mikel John Stanich, Longmont, CO (US); Kartheek Chandu, Longmont, CO (US); Larry M. Ernst, Longmont, CO (US)

(72) Inventors: Mikel John Stanich, Longmont, CO (US); Kartheek Chandu, Longmont, CO (US); Larry M. Ernst, Longmont, CO (US)

(73) Assignee: Ricoh Company, LTD., Tokyo (JP)

( * ) Notice: Subject to any disclaimer, the term of this patent is extended or adjusted under 35 U.S.C. 154(b) by 0 days.

(21) Appl. No.: 14/485,357

(22) Filed: Sep. 12, 2014

(51) Int. Cl.
*B41J 29/393* (2006.01)
*B41J 2/045* (2006.01)

(52) U.S. Cl.
CPC ..... *B41J 29/393* (2013.01); *B41J 2/04581* (2013.01); *B41J 2/04591* (2013.01); *B41J 2029/3935* (2013.01)

(58) Field of Classification Search
CPC ..... B41J 2029/3935; B41J 2/04558; B41J 2/2132; B41J 2/2146; B41J 2/04505
See application file for complete search history.

(56) References Cited

U.S. PATENT DOCUMENTS

| | | | | |
|---|---|---|---|---|
| 6,076,915 | A | 6/2000 | Gast et al. | |
| 7,478,894 | B2 | 1/2009 | Kim et al. | |
| 7,567,267 | B2 | 7/2009 | Barron | |
| 8,047,627 | B2 | 11/2011 | Ye | |
| 2009/0160900 | A1 * | 6/2009 | Niida et al. | 347/19 |
| 2012/0092403 | A1 * | 4/2012 | Profaca et al. | 347/14 |
| 2013/0021398 | A1 | 1/2013 | Mizes et al. | |
| 2013/0155139 | A1 | 6/2013 | Elliot et al. | |

* cited by examiner

*Primary Examiner* — Julian Huffman
(74) *Attorney, Agent, or Firm* — Blakely, Sokoloff, Taylor & Zafman LLP

(57) ABSTRACT

A method is described that entails printing a series of test patterns. Each test pattern has its own respective set of outer lines and set of inner lines. The series of test patterns have a different intended spacing between their respective inner lines and outer lines. The intended spacing of each test pattern is printed in a manner that correlates the intended spacing of each test pattern with its test pattern. Each of the outer lines are printed with a first print source and each of the inner lines printed with a second print source. Inner lines of a first set of the test patterns are shorter than inner lines of a second set of the test patterns to enhance resolution at which differences in the spacings between respective inner and outer lines of same test patterns are able to be detected across different test patterns.

20 Claims, 9 Drawing Sheets

TEST PATTERNS FOR PRINT HEADS HAVING TWO IMAGE SOURCES

FIELD OF INVENTION

The field of invention pertains generally to printer technology, and, more specifically, to test patterns for print heads having two image sources

BACKGROUND

Printers, such as ink-jet printers, include mechanical assemblies to affect the transfer of ink onto a moving sheet of paper. These mechanical assemblies can include multiple ink-jets or other ink transfer mechanics that need to work correctly in unison in order to correctly print images on the paper.

As an example, a color ink-jet printer typically includes both a black ink printhead and plumbing assembly and a colored ink printhead and plumbing assembly. Colored or even black-and-white printers may also include multiple print-heads to affect denser dots-per-inch (DPI) and/or faster printing capability. As is known in the art, the term "PEL" corresponds to the distance between neighboring dots (e.g., the distance of a PEL can be determined by taking the inverse of the DPI of the printer). In many cases the DPI of the printer may be different in each direction, having one DPI along the direction of the movement of the paper and a second DPI in an orthogonal direction between the nozzles of the printheads.

Whenever multiple print sources (e.g., multiple ink-jets, multiple print-heads, etc.) are incorporated into a single printer, the "alignment" of these image sources, in time and/or space, becomes an important determinant of the quality of the overall printed image.

For example, FIGS. 1*a* and 1*b* depict a problem when two different print sources are temporally misaligned (i.e., mis-aligned in time). In the example of FIG. 1*a-b*, two print sources are attempting to print a straight, vertical line 104 while a piece of paper 105 is moving vertically in the printable range of the print sources. Here, for simplicity, the print source used to print features 101 and 103 can be assumed to be of a first type (e.g., a black ink-jet assembly) while the print source used to print feature 102 is assumed to be of a second, different type (e.g., a colored ink-jet assembly).

To form the printed line, as the paper is moving in the print area of the two print sources, the first print source (e.g., the black ink jet) will first print feature 101. Then, the first print source will stop printing and the second print source (e.g., the color ink jet) will print feature 102. Then, the second print source will stop printing and the first print source will begin printing feature 103. Ink jet printers often operate on a drop wise basis. The ejection of droplets or "jetting", in some cases, drops different volumes to form the printed PELS on paper. The position of PELs along the direction of web movement is controlled by the timing of drop jetting while the location of the PELS perpendicular to the web movement direction is controlled by the spatial placement of jetting nozzles.

Given that the ideal arrangement of these features creates a "dashed" line with centered/equi-distant dashes having alternating color and black "dashes" the printed line should not have exhibit any overlap of the features 101, 102, 103 that were printed by the different print sources. To correctly draw such a line in the direction that the paper is moving, the different print sources need to synchronously jet drops of ink at the correct moment in time. Specifically, the source that prints feature 101 needs to stop jetting PELs approximately when the source that prints the PELs of feature 102 starts to jet, to produce properly positioned segments of the dashed line. Likewise, the source that prints feature 102 needs to stop jetting PELS approximately when source that prints feature 103 starts to jet PELs, to produce properly positioned segments of the lower portion of the dashed line.

Because the print sources are electromechanical and/or fluidic machines, there can be variability between the jetting of ink drops that produces PEL misplacements on the printed output even if the timing of the electronic signal that triggers the jetting is very consistent. For example in the case of an ink-jet, the various tolerances of printhead nozzles locations, pressure, spacing etc. all lend themselves to drop misplacements relative to an ideal uniformly spaced printer grid.

As such, the printed line may appear as in FIG. 1*b* where the feature 102 undesirably overlaps with feature 101. That is, the source that printed feature 102 jetted drops too soon and/or the source that printed feature 101 jetted drops too late.

Moreover, whereas FIGS. 1*a-b* pertain to temporal mis-alignment between two different colors, FIG. 2 pertains to an example of temporal mis-alignment of interleaved printheads having the same color. Inset 210 shows an interleaved print head approach that attempts to increase the resolution of the printed image by deliberately offsetting the alignment of two print heads 201, 202. Here, for example, if both print heads 201, 202 correspond to a 600 DPI print-head, a printed image resolution of 1200 DPI can be achieved by off-setting the lateral alignment between them by one half of the PEL distance 203 of each print head.

In a typical interleaved print-head solution, one of the print heads is used to print odd number columns and the other print head is used to print even numbered columns. Here, the entire printed image is viewed as a matrix of rows and columns where each element of the matrix corresponds to a printed image "dot" (which is also frequently referred to as a PEL). Thus, "left" print head 201 is configured to print the odd numbered columns and "right" print head 202 is configured to print the even numbered columns.

FIG. 2 demonstrates that a printing error like the printing error of FIG. 1*b* can result if the vertical spacing 204 between the print heads is misaligned. Here, an attempt is made to print a vertical "line" where the line consists of alternating odd and even columned dashes. Because of the intentional lateral alignment 203 between the dual print-heads, note that features 205, 207 printed with print head 201 in an odd column are offset and not horizontally aligned with the feature 206 printed with print head 202 in an even column (the pattern is printed with the first print head 201 printing feature 205, then the second print head 202 printing feature 206, then the first print head printing feature 207).

As observed in FIG. 2, if the vertical spacing 204 between the print heads 201, 202 is smaller than the nominal value and the printing between 205, 206 and 207 is nominal, the even column printed feature 206 can overlap or nearly overlap with the odd column printed image data.

The printing error of FIG. 2 results from a temporal alignment between the two print heads 201, 202 as discussed above with respect to FIGS. 1*a* and 1*b*, which must account for variations in spacing 204 between the interleaved printheads.

FIG. 3 shows a prior art test pattern that can be used to detect either temporal or mechanical mis-alignments in a printer having interleaved multiple print sources. The web movement direction is vertical and therefore the timing between the jetting of each printhead influences the vertical position of the lines. Each line is dashed so that a line is printed only by the nozzles of its respective interleaved printhead. Generally, the position of horizontal middle lines 301 is observed between an arrangement of horizontal outer line pairs 302. Misalignments are detected by observing when a horizontal middle line 301 becomes too close to a horizontal outer line 302. Unfortunately determination of the amount of misalignment, and therefore the necessary alignment compensation, cannot be easily determined from the detected misalignment.

In one implementation of the prior art pattern of FIG. 3, the pattern depicted in FIG. 3 is repeated multiple times with different colors. The outer lines 302 or inner lines 301 would be printed with a single color so as to permit one to gauge the printing misalignment from a reference color.

FIGURES

A better understanding of the present invention can be obtained from the following detailed description in conjunction with the following drawings, in which:

FIGS. 1*a* and 1*b* show the proper color registration and a color registration problem, respectively;

Figure 1A:
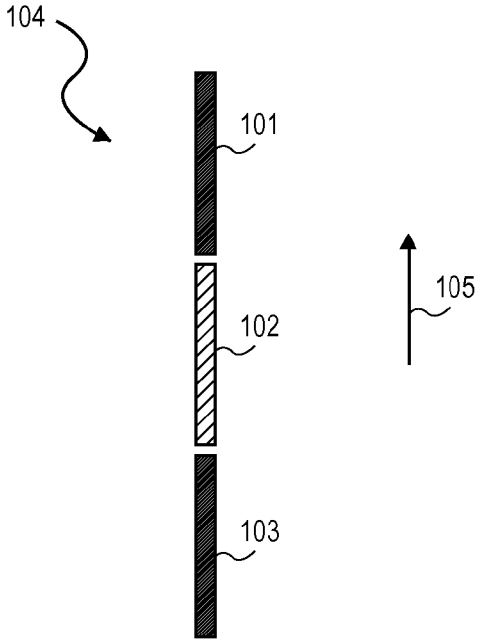
Figure 1B:
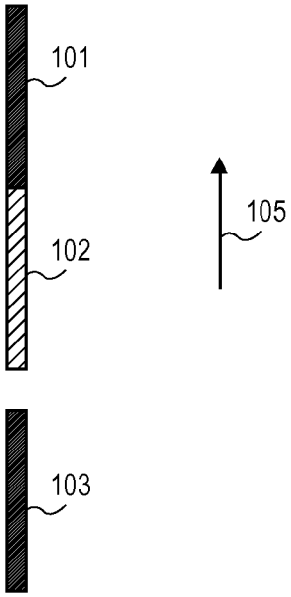
Figure 2:
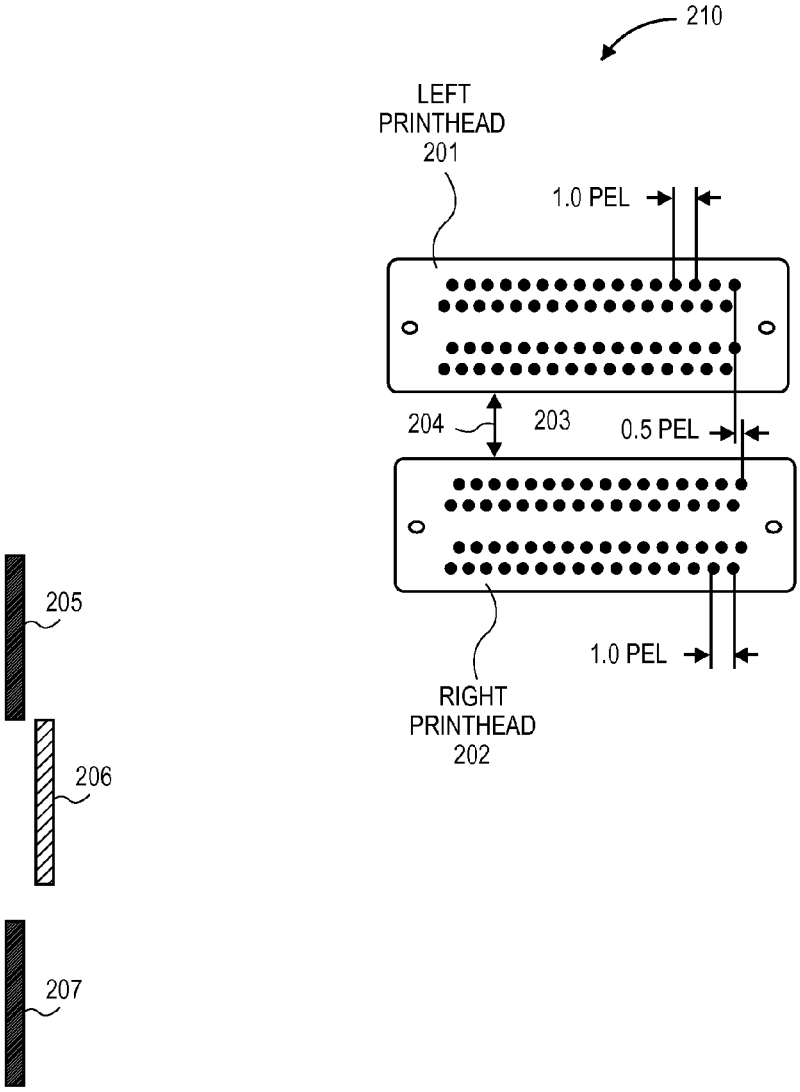
FIG. 2 shows a vertical registration problem for interleaved printheads.
Figure 3:
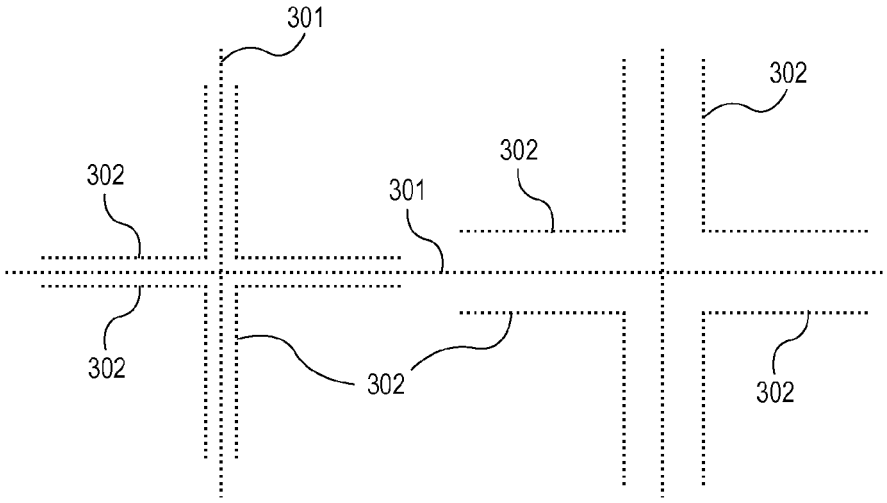
FIG. 3 (PRIOR ART)
FIG. 3 shows a prior art test pattern.
Figure 4A:
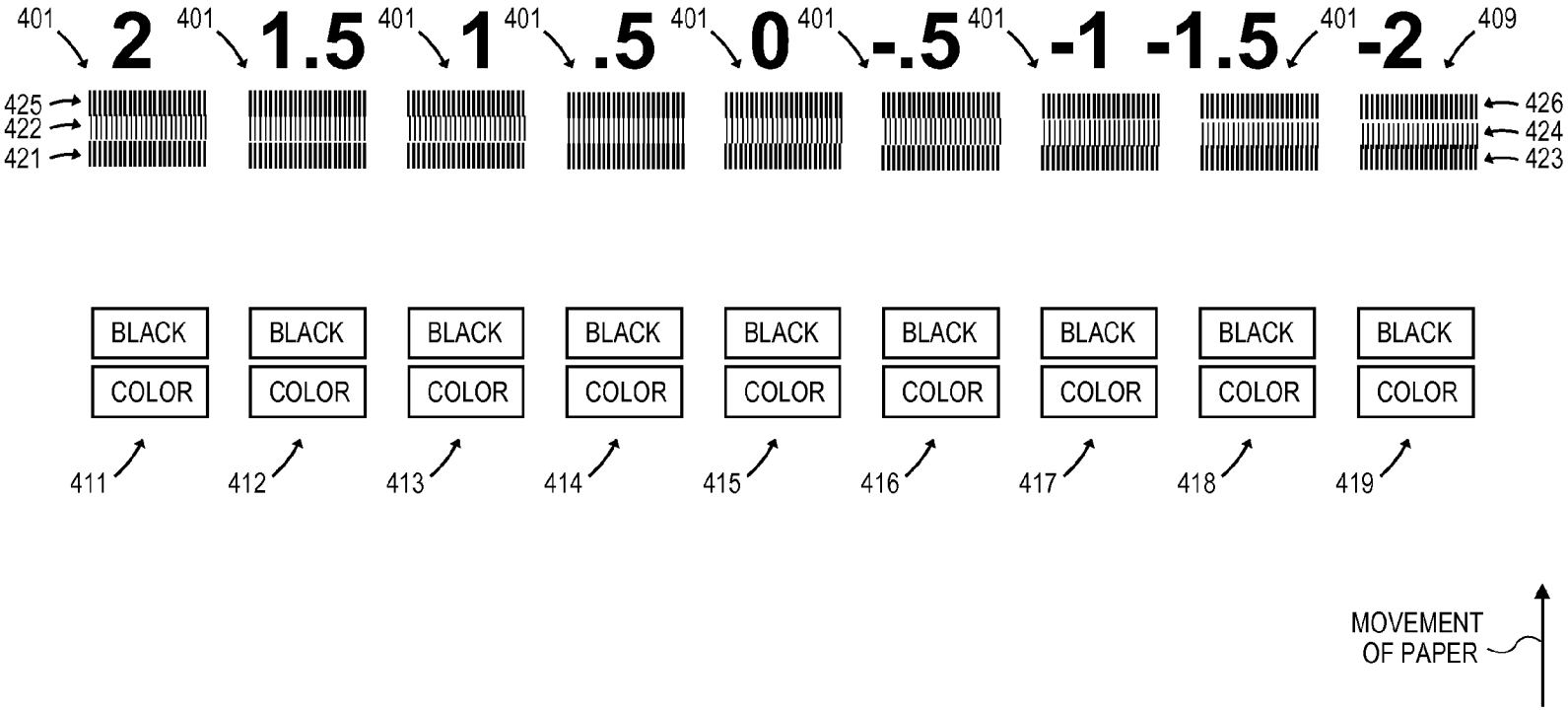
Figure 4B:
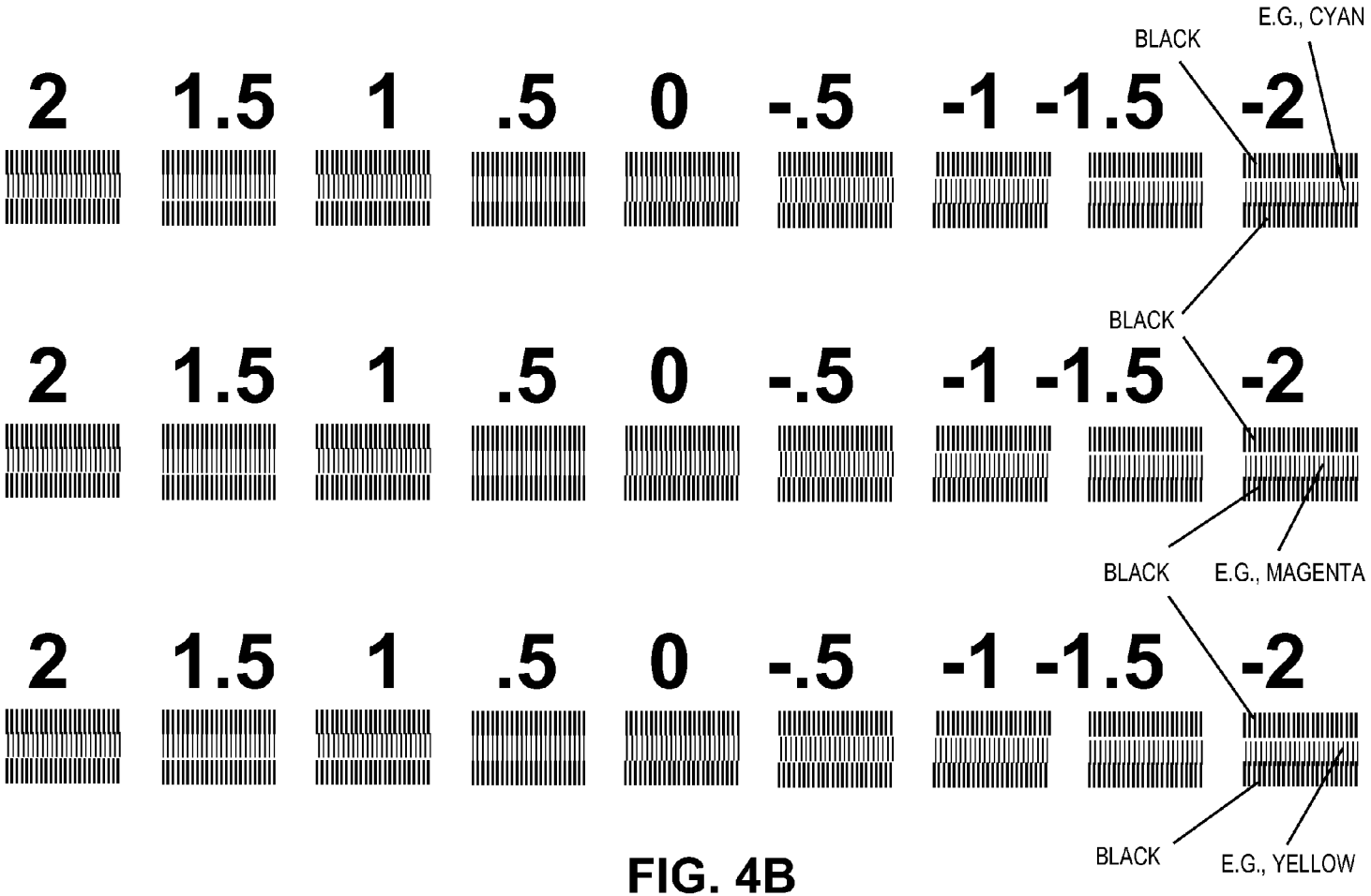
Figure 5:
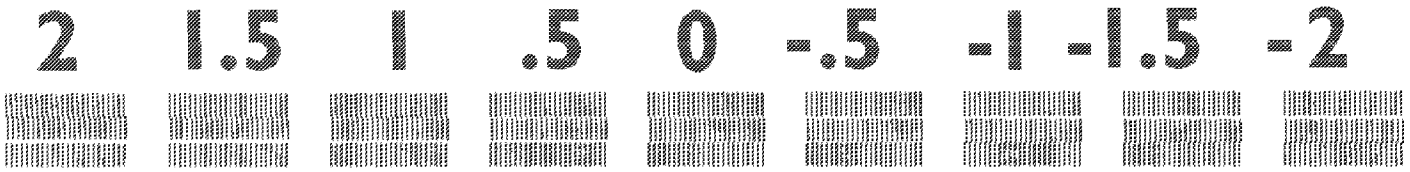
Figure 6:
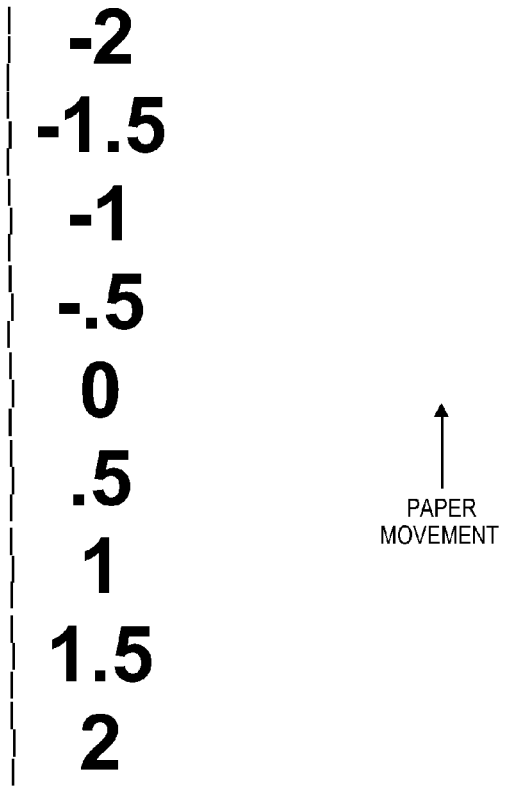

FIGS. 4*a* and 4*b* pertain to first and second improved test pattern embodiments;

FIG. 5 pertains to a third improved test pattern embodiment;

FIG. 6 pertains to a fourth improved test pattern embodiment

Figure 7:
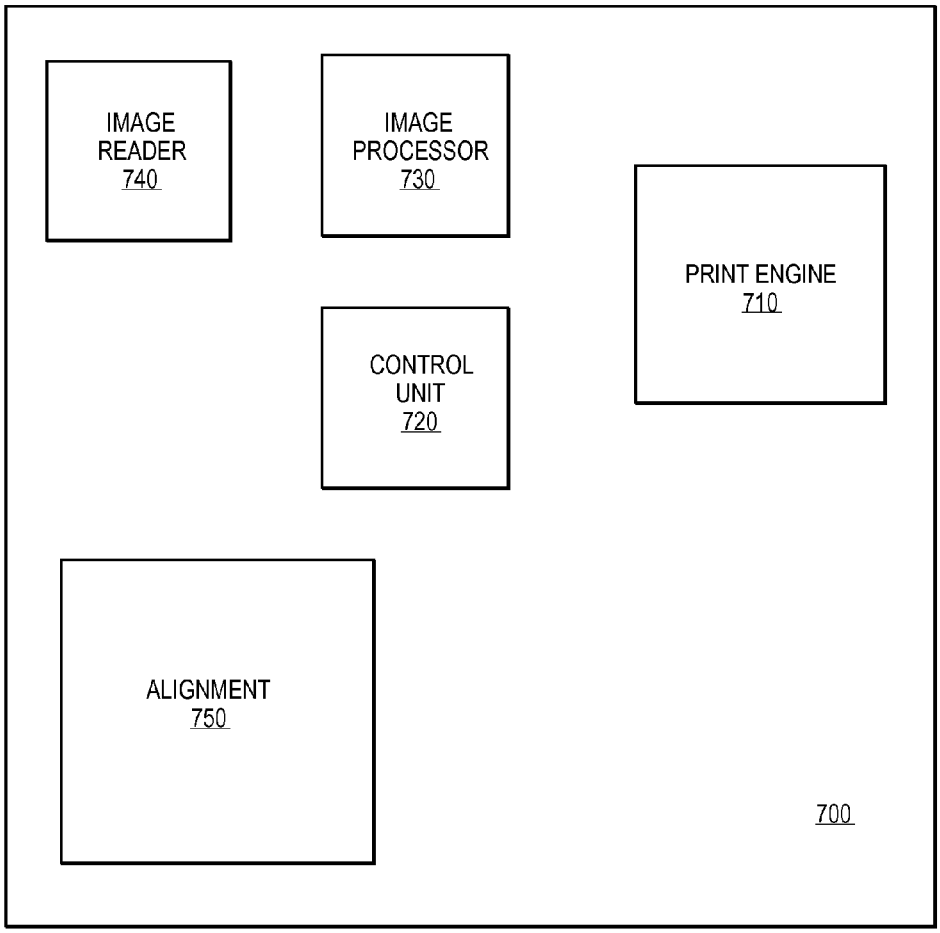
Figure 8:
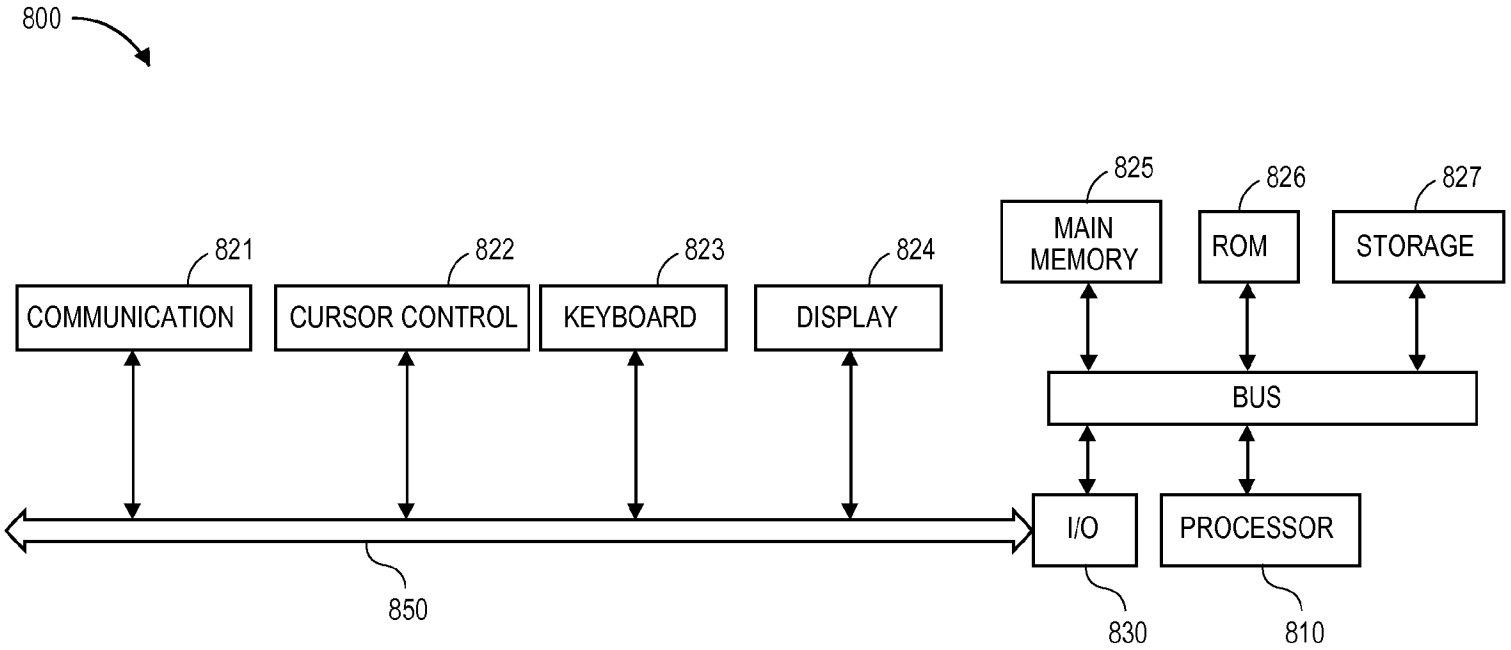

FIG. 7 depicts an embodiment of a printer;

FIG. 8 depicts an embodiment of a computing system

DETAILED DESCRIPTION

FIG. 4*a* pertains to an improved approach that includes not only imagery from which mis-alignment can be detected, but also includes information that indicates the amount of mis-alignment. The amount of mis-alignment information can then be used to subsequently apply the precise compensation to the printing apparatus to substantially eliminate printing errors that result from the mis-alignment.

As observed in FIG. 4*a*, a series of test patterns 401-409 are printed, where, each test pattern in the series attempts to print features (e.g., lines) with a different relative alignment. In an embodiment, the lengths of the outer two sets of lines in each pattern 401-409 are "fixed" such that the outer two sets of lines in each group have the same length, start and end positions along the direction of the movement of the paper. Reference 421 points to the lower sets of lines in group of lines 401. Reference 423 points to the lower sets of lines in group of lines 409. Reference 425 points to the top set of lines for group of lines 401. Reference 426 points to the top set of lines for group of lines 409.

Sets of lines in the middle of each group, indicated by reference 422 for group 401 and reference 424 for group 409, vary in length and position relative to the outer sets of lines across the groups as discussed immediately below.

The length of the inner lines for each group having negative integer, zero and positive integer labels are the same length. However, the inner lines for all of the groups labeled with a 0.5 PEL offset ("1.5", "0.5") are one PEL shorter in length than the middle lines for groups labeled with an integer offset (e.g., "1.0", "−1.0"). Since the judgment of the required offset is based on centering such that, for any one group, the "gap" or "spacing" that appears between the top of the middle set of lines and the bottom of the upper, outer set of lines is equal to the "gap" or "spacing" that appears between the bottom of the middle set of lines and the top of the bottom, outer sets of lines, the one PEL shorter line must be shifted an additional one half PEL in time to appear centered between the outer lines. Hence the shortened lines provide granularity to the pattern of one half PEL. In alternate embodiments, differences between line lengths could be adjusted accordingly to provide for even finer measurement resolutions (e.g., 0.25 PEL).

The line pattern group labeled as having zero offset ("0") has the center group of lines centered between the bottom of the top pattern and the top of the bottom pattern of lines. Hence an equal number of white PELs exists above and below the center pattern for the zero offset group. The minus one PEL offset group ("−1") has an increased space of one PEL between the top of the center lines and the bottom of the top pattern. The space at the top of each center patterns increases by an additional PEL for each decrease in the stated integer offset.

Similarly, for the line groups having positive integer offsets ("1", "2"), the spacing between the patterns between the bottom of the top patterns and the top of the middle patterns is decreased by an additional one PEL for each integer increase in offset. The line group labeled as having a "−0.5" offset has lines in the center pattern that are one PEL shorter than the integer offset lines. The white gap between bottom of the center group and the top of the bottom group is the same as the zero offset pattern.

The −1.5 PEL offset pattern has the same center line length as the −0.5 pattern, however the center pattern is shifted one PEL down. Similarly for the positive offset groups, the length is shortened for the half PEL groups and displaced in the opposite direction as the negative offset groups. The patterns depicted in FIG. 4*a* show ideal patterns by design without the displacements that will occur between the patterns due to mis-timing of printing between printheads. The series of test patterns 401-409 include groups of patterns that when printed represent a range of alignments within the expected range of potential mis-alignments of the printing assembly (e.g., within a range+2.0 to −2.0 PEL in 0.5 PEL increments). The printed test pattern is then observed (manually or via automation) to detect which of the groups of test patterns appear best aligned.

The criteria "best aligned" occurs when the white "gap" above and white "gap" below the center pattern appears the same. The top gap is formed between the top of the center lines and the bottom of the top pattern and the bottom gap is formed between the bottom of the center lines and the top of the bottom pattern. The offset labels indicate the misalignment in units of PELs.

The actual offset of these line patterns is created based on the timing of the jetting of the PELs. The timing granularity can be a small fraction of a PEL. The equal gap approach allows the patterns to be read so as to indicate when the timing is off with a granularity of one half PEL.

The gap approach can be extended by observing the gaps between the top gap of each group and the bottom gap of each group. For example if the equal gap approach indicates −0.5 PEL offset is present, the zero and −1 PEL groups will have equal gaps visually for the bottom gap of the 0 group and the top gap of the −1 group. This should be the case for all patterns that have the same minus and plus symmetrical offsets about the equal gap pattern. Using an automated approach based on the gaps or line positions or gauging the offsets visually permits offsets with granularity smaller than half PEL. The information associated with the test pattern that appears best aligned corresponds to the appropriate compensation that should be applied to the printing apparatus.

Referring to FIG. 4*a*, the printer is assumed to include multiple pairs of print source assemblies (e.g., ink-jets) 411-419. Each pair includes, for instance, a black print source and a color print source. A row of such pairs 411-419 are formed across the width of a page of paper that moves vertically, e.g., from bottom to top as observed in FIG. 4. In some cases multiples rows of pairs of print sources may be required to fill the missing regions between pairs.

Although forming an array of print source pairs 411-419 as depicted in FIG. 4*a* is one way to create the test patterns 401-409, other print head design assemblies may also be used. For example, at the other extreme, only a single print source pair is utilized and the paper movement "stops and goes back" so that the single print source pair can traverse across the fixed page and print each of the test patterns 401-409 individually at approximately the same lateral position associated with each of pairs 411-419. Thus the embodiment of FIG. 4*a* should be understood to be printable by a number of different print head hardware assembly embodiments. For the sake of convenience the subsequent discussion will assume that each printhead pair 411-419 corresponds to a unique and different print head.

Each print source of the same type (e.g., all the black print sources) can be individually controlled electronically and share at least some component of same plumbing (e.g., a black ink reservoir). Likewise, each color ink jet print head can be individually controlled electronically and share the same color ink-jet reservoir and associated plumbing.

Initially, before alignment is tested by way of the printed test pattern, the printer may assume there is no timing offset/difference as between the nominally located black print head array and the nominally located color print head array. The test pattern is aimed at quantifying such offsets/differences from the nominal location, if any exist.

In forming the print-out, the left most black/colored print head pair 411 attempts to print with a zero PEL offset between the timing of the turn off of the black ink-jet in the forming of lower feature of the fixed patterns and the turn on time of the color ink-jet in forming the middle feature of the zero offset pattern (a PEL distance can readily be converted into a time span based on the movement of the paper as described further below).

If the printheads are located at their nominal locations and no additional factors are present, such as the spacing between printheads and paper, the printed version of the zero offset pattern and the other patterns will resemble the ideal patterns as shown in the top part of FIG. 4*a*. If the printed version appears different than the ideal pattern the amount of compensation required can be determined by identifying the pattern where the central line pattern is centered vertically within the outer pattern of lines. The assigned label for the group having the equal gap characteristics identifies the compensation, when converted to time, required to alter the jetting of the color printhead printing to achieve proper alignment between the printheads. A positive value for the label corresponding to the equal gap condition, requires a decrease of the current jetting time delay between the black and color printhead.

The additional print head pairs 412-418 would all be tested at the same time in the manner described. In an embodiment, a set of patterns as shown in FIG. 4*a* are printed for each printhead pair and interpreted based on the equal gap determination. The required set of temporal offsets from nominal for each would be determined from a single printing of the combined testmaster and entered as new values for the time delays for the printhead controller. Repeating this printing and interpreting process with the new set of timings permits verification of the new time delays and if required provides additional opportunity to further "fine tune" the delays to perfect the printing relationship between the black and color printheads. When the set of delays is perfected the FIG. 4*a* pattern depicts the print-out of a printer having perfect timing between the black/color print head pairs within the print head array. After perfecting the test pattern 405, having "0" as its mis-alignment information label, appears to be the best aligned equal gap test pattern. The information of "0" means that the print apparatus has correct timing and therefore no fix is necessary.

The timing offset for a particular test pattern having an associated PEL offset as taken from the test pattern print out can be calculated from the velocity at which the paper moves. For example, the PEL distance can be converted directly into a time by dividing the PEL distance by the paper velocity. Thus, for a 1200 DIP printer, the temporal offset where the lines of the "+1.5 PEL" test pattern appear to be aligned can be calculated as $((1.5)(1/1200))/(\text{paper_velocity})$.

With the PEL number being converted into a timing offset, an adjustment could be made as discussed above to a print head that is turning on or off too soon by configuring it to delay its turn on or off by the temporal offset. Alternatively, an adjustment could be made to a print head that is turning on or off too late by configuring it to advance in time its turn on or turn off by the temporal offset. The patterns shown in FIG. 4*a* illustrate that the lines within the center pattern are offset slightly to the right from the outer pattern lines. The lines printed by the color printhead for the center pattern could in fact be in-line with the top and bottom outer line patterns.

Whereas FIG. 4*a* pertains to only one printed color, FIG. 4*b* shows an extended embodiment test pattern that applies the same test for each of three colors (e.g., Cyan, Magenta, Yellow). Here, for example, the color print-head discussed above may be a multi-color print head that is supplied by three different colored ink reserves and associated plumbing.

The approach of the printed test pattern described above can be applied to correct for various other forms of temporal mis-alignment as discussed in more detail immediately below.

A set of patterns like that shown in FIG. 4B is required to be printed for each set of CMY and K printheads and hence they must be positioned such that each set of patterns is printed by its corresponding set of printheads with each having a corresponding set of compensation data.

As described the pattern described in FIG. 4*a* is used for adjustment of the timing between and black and color printhead. In general the PELs printed by the color printhead are horizontally aligned with the corresponding PEL in the black printhead. More generally, the patterns of FIGS. 4*a* and 4*b* can be said to apply for any pair of print sources.

As a demonstration of the versatility of the test pattern approach described above, referring now to FIG. 5, the test pattern observed in FIG. 5 is a test pattern for a monochrome printer having interleaved print heads. As such, each print head pair consists of an upper and lower black ink print head. The manner and use of the test pattern of FIG. 5 is essentially the same as that described above with respect to FIGS. 4*a* and 4*b*.

FIG. 6 shows an alternate embodiment of the test patterns of FIGS. 4*a-b* and 5. Here, whereas the test patterns of FIGS. 4*a-b* and 5 essentially assumed the timing of the print head pairs across a print head array were identical, by contrast, the embodiment of FIG. 6 is designed to test a narrower printhead. As with the patterns of FIGS. 4*a,b* and 5, middle lines of integer labeled line groups and middle lines of half PEL labeled line groups differ in length by one half PEL to ease detection of middle/outer line gaps to one half PEL resolution (outer lines of all groups have the same length). Application of the test pattern of FIG. 6 with a narrower print head allows one to create a pattern having a larger range of offsets. Alternately, multiple copies of this pattern could also be used for a wide printhead array to gauge how consistent the timing is across the printhead. For example, if the printhead was rotated about the direction the ink is ejected the timing for the left, center and right portions of the printhead could be different allowing different compensation values to be applied across the printhead as determined by the local measurements at specific points.

Finally, another application of the pattern in FIG. 6 is to determine the offset between adjacent printheads whereas the left column of lines is printed with the right most nozzle of a left printhead and the right column of lines is printed with the left most nozzle of an adjacent printhead to the right. It should be appreciated that each individual adjacent printhead may be located displaced in the web movement direction from its adjacent printhead to allow for physical packaging. As such, each may require different offsets. In this manner the alignment compensation of multiple printheads can be determined relative to the reference printhead.

Here, FIG. 6 shows a correctly timed print head pair in which the "0" offset test pattern has its middle line being centered within its respective outer lines. By contrast, if the test pattern where to print with the middle line of the +1.5 PEL test pattern being centered between its outer lines, the particular print-head being tested would be exhibiting a +1.5 PEL timing error between its left and right print heads that needs to be compensated for.

Note that whereas the above discussions of FIGS. 4, 5 and 6 assumed that any printing errors were the result of an undesirable timing error between print source pairs, in fact, a mechanical mis-alignment could produce the same effects. That is, centering of the middle lines in any test pattern other than the "0" PEL offset test pattern could also be produced by a pair of print sources that had correct timing between them but were mechanically misaligned with respect to the vertical spacing between them.

In various implementations, the test print patterns discussed above may be stored in, e.g., non volatile storage of the printer and called upon to be printed (e.g., in response to push button presses on an interface by a user). A control unit and/or graphics processor within the printer then causes the test print patterns that are stored in non volatile storage to be printed. Alternatively, the test print patterns may be loaded into the printer through an I/O component of the control unit (e.g., a memory stick, CD ROM or downloaded over a network through a network interface).

FIG. 7 illustrates one embodiment of a printer 700. Printer 700 includes print engine 710, control unit 720, image processor 730, and image reader 740. Print engine 710 includes the print heads that apply ink to a print medium (e.g., paper). In one embodiment, print engine 710 includes at least four print heads arranged in a fixed inkjet print head array. In a further embodiment, print heads associated with a single color are located within the same print head tray.

Control unit 720 controls the operation of print engine 710, while image processor 730 performs rasterization of image data received at printer 700. Rasterization converts information received at printer 700 into a raster format. Particularly, image processor 730 generates a raster scan of a received image that is to be stored as scan line data in a memory array. Subsequently, image processor 730 performs halftone processing of the scan line data stored in the memory array. Control unit 720 also verifies the output of print engine 710 upon receiving image data captured by image reader 740.

Printer 700 also includes a print head alignment system 750. Alignment system 750 is implemented to provide an alignment of print engine 710 associated with each individual ink color with respect to a reference position. In a further embodiment, alignment system 750 provides a framework for computing a magnitude of misalignment between print heads in fixed print head array arrangements. Although shown as residing a component of printer 700, other embodiments may feature alignment system 750 as an independent device, or combination of devices, that is communicably coupled to printer 700. Various fixes to problems exhibited by the aforementioned printouts my be addressed via manipulation of the alignment system 750.

Control unit 720 may be implemented as a form of computing system having a central processing unit and associated system memory and non volatile storage. An exemplary computing system is depicted in FIG. 8. Control unit 720 may include various components of the computing system of FIG. 8.

FIG. 8 illustrates a computer system 800 on which printer 800 and/or alignment system 850 may be implemented. Computer system 800 includes a system bus 1020 for communicating information, and a processor 810 coupled to bus 820 for processing information.

Computer system 800 further comprises a random access memory (RAM) or other dynamic storage device 825 (referred to herein as main memory), coupled to bus 820 for storing information and instructions to be executed by processor 810. Main memory 825 also may be used for storing temporary variables or other intermediate information during execution of instructions by processor 810. Computer system 800 also may include a read only memory (ROM) and or other static storage device 826 coupled to bus 820 for storing static information and instructions used by processor 810.

A data storage device 825 such as a magnetic disk or optical disc and its corresponding drive may also be coupled to computer system 800 for storing information and instructions. Computer system 800 can also be coupled to a second I/O bus 850 via an I/O interface 830. A plurality of I/O devices may be coupled to I/O bus 850, including a display device 824, an input device (e.g., an alphanumeric input device 823 and or a cursor control device 822). The communication device 821 is for accessing other computers (servers or clients). The communication device 821 may comprise a modem, a network interface card, or other well-known interface device, such as those used for coupling to Ethernet, token ring, or other types of networks.

Embodiments of the invention may include various processes as set forth above. The processes may be embodied in machine-executable instructions. The instructions can be used to cause a general-purpose or special-purpose processor to perform certain processes. Alternatively, these processes may be performed by specific hardware components that contain hardwired logic for performing the processes, or by any combination of programmed computer components and custom hardware components.

Elements of the present invention may also be provided as a machine-readable medium for storing the machine-executable instructions. The machine-readable medium may include, but is not limited to, floppy diskettes, optical disks, CD-ROMs, and magneto-optical disks, FLASH memory, ROMs, RAMs, EPROMs, EEPROMs, magnetic or optical cards, propagation media or other type of media/machine-readable medium suitable for storing electronic instructions. For example, the present invention may be downloaded as a computer program which may be transferred from a remote computer (e.g., a server) to a requesting computer (e.g., a client) by way of data signals embodied in a carrier wave or other propagation medium via a communication link (e.g., a modem or network connection).

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims, which in themselves recite only those features regarded as essential to the invention.

The invention claimed is:

1. A method, comprising:

printing a series of test patterns, each test pattern having its own respective set of outer lines and set of inner lines, the series of test patterns having a different spacing between respective inner lines and outer lines, the spacing of each test pattern being printed in a manner that correlates the spacing of each test pattern with an associated test pattern, each of the outer lines printed with a first print source and each of the inner lines printed with a second print source, wherein inner lines of a first set of the test patterns are shorter than inner lines of a second set of the test patterns to enhance resolution at which differences in the spacing between respective inner and outer lines of same test patterns are able to be detected across different test patterns.

2. The method of claim 1 wherein features of the series of test patterns are printed parallel to the direction in which the paper that the series of test patterns are printed on moves.

3. The method of claim 1 wherein groups within the series of test patterns are printed orthogonal to the direction in which the paper moves.

4. The method of claim 1 where the inner lines are a different color than the outer lines.

5. The method of claim 4 wherein the outer lines are black.

6. The method of claim 1 wherein the different spacing for each group of lines between the respective inner lines and outer lines of the test patterns vary in accordance with the length of the lines, so to provide 0.5 PEL resolution for the pattern.

7. The method of claim 1 wherein the outer lines are black.

8. A printer, comprising:

non volatile storage and processor to store and process instructions to perform a test pattern printing process, said test pattern printing process comprising:

printing a series of test patterns, each test pattern having its own respective set of outer lines and set of inner lines, the series of test patterns having a different spacing between respective inner lines and outer lines, the spacing of each test pattern being printed in a manner that correlates the spacing of each test pattern with an associated test pattern, each of the outer lines printed with a first print source and each of the inner lines printed with a second print source, wherein inner lines of a first set of the test patterns are shorter than inner lines of a second set of the test patterns to enhance resolution at which differences in the spacing between respective inner and outer lines of same test patterns are able to be detected across different test patterns.

9. The printer of claim 8 wherein the series of test patterns are printed orthogonal to the direction in which the paper that the series of test patterns are printed on moves.

10. The printer of claim 8 wherein the series of test patterns are printed along the direction in which the paper that the series of test patterns are printed on moves.

11. The printer of claim 8 where the inner lines are a different color than the outer lines.

12. The printer of claim 8 wherein the outer lines are black.

13. The printer of claim 8 wherein the different spacing for each group of lines between the respective inner lines and outer lines of the test patterns vary in accordance with the length of the lines, so to provide 0.5 PEL resolution for the pattern.

14. The printer of claim 8 wherein the outer lines are black.

15. A machine readable medium containing program code that when processed by a computing system causes a method to be performed, said method comprising:

printing a series of test patterns, each test pattern having its own respective set of outer lines and set of inner lines, the series of test patterns having a different spacing between respective inner lines and outer lines, the spacing of each test pattern being printed in a manner that correlates the spacing of each test pattern with an associated test pattern, each of the outer lines printed with a first print source and each of the inner lines printed with a second print source, wherein inner lines of a first set of the test patterns are shorter than inner lines of a second set of the test patterns to enhance resolution at which differences in the spacing between respective inner and outer lines of same test patterns are able to be detected across different test patterns.

16. The machine readable medium of claim 15 wherein the series of test patterns are printed orthogonal to the direction in which the paper that the series of test patterns are printed on moves.

17. The machine readable medium of claim 15 wherein the series of test patterns are printed along the direction in which the paper that the series of test patterns are printed on moves.

18. The machine readable medium of claim 15 where the inner lines are a different color than the outer lines.

19. The machine readable medium of claim 15 wherein the outer lines are black.

20. The machine readable medium of claim 15 wherein the different spacing for each group of lines between the respective inner lines and outer lines of the test patterns vary in accordance with the length of the lines, so to provide 0.5 PEL resolution for the pattern.

* * * * *